United States Patent [19]

Pearson

[11] 4,222,211

[45] Sep. 16, 1980

[54] STRADDLING STACKABLE STUD

[75] Inventor: Robert J. Pearson, Tonawanda, N.Y.

[73] Assignee: National Gypsum Company, Dallas, Tex.

[21] Appl. No.: 12,209

[22] Filed: Feb. 14, 1979

Related U.S. Application Data

[63] Continuation-in-part of Ser. No. 870,368, Jan. 18, 1978.

[51] Int. Cl.[3] ..... E04G 21/14

[52] U.S. Cl. ..... 52/741; 52/241

[58] Field of Search ..... 52/241, 242, 361–363, 52/481, 732, 738, 741; 403/241, 253, 255

[56] References Cited

U.S. PATENT DOCUMENTS

| | | | |
|---|---|---|---|
| 1,810,597 | 6/1931 | Corwin | 52/700 |
| 2,073,781 | 3/1937 | Calafati | 52/363 |
| 2,114,901 | 4/1938 | Henderson | 52/732 |
| 2,138,291 | 11/1938 | Callaghan | 52/241 |
| 3,125,193 | 3/1964 | Brown et al. | 52/481 |
| 3,320,710 | 5/1967 | Byssing | 52/241 |

*Primary Examiner*—James L. Ridgill, Jr.
*Attorney, Agent, or Firm*—Robert F. Hause

[57] ABSTRACT

An elongate sheet metal stud having a cross-section including a central web and two oppositely directed flanges on the two sides of the stud extending perpendicularly from the web, and having the ends of the flanges detached from the web and free to straddle the floor and ceiling tracks, permits ease of stacking a plurality of studs and provides firmness while screwing board to the flanges.

3 Claims, 3 Drawing Figures

STRADDLING STACKABLE STUD

This application is a continuation-in-part of my application Ser. No. 870,368, filed Jan. 18, 1978.

This invention relates to a sheet metal stud for erecting wallboard and particularly to a double L-shaped stud with recesses in the web on each end for engaging floor and ceiling tracks.

The most common sheet metal studs, used for screw attachment of wallboards, are of a C-shaped cross-section. These C-shaped studs are mounted with a bottom end disposed between upstanding flanges on a floor runner, and with a top end disposed between downwardly extending flanges of a ceiling runner. One problem with the C-shaped sheet metal studs is that a group of them cannot be stored or shipped all closely nested and, thus, in storage and shipping, they must consequently take up a large volume of space.

The present invention is directed to an improved stud in which one of the C-shaped stud flanges is directed in the opposite direction from the central web, forming a double L-shaped stud. The ends of the double L-shaped stud have recessed portions which permit the studs to straddle the floor runners and ceiling runners, to give stability to the stud when wallboard is being screw-attached to the two flanges. A prior patent, U.S. Pat. No. 3,606,418, discloses double L-shaped structural members, but for a different structural use and lacking the recessed end portions or anything comparable.

It is an object of the present invention to provide a novel metal stud for screw attachment of wallboard thereto.

It is a futher object to provide a novel wall structure embodying the improved stud.

It is a still further object to provide a novel method of erecting a wall embodying the improved stud.

These and other objects of the invention will be more readily apparent when considered in relation to the preferred embodiments as set forth in the specification and shown in the drawings in which.

Figure 1:
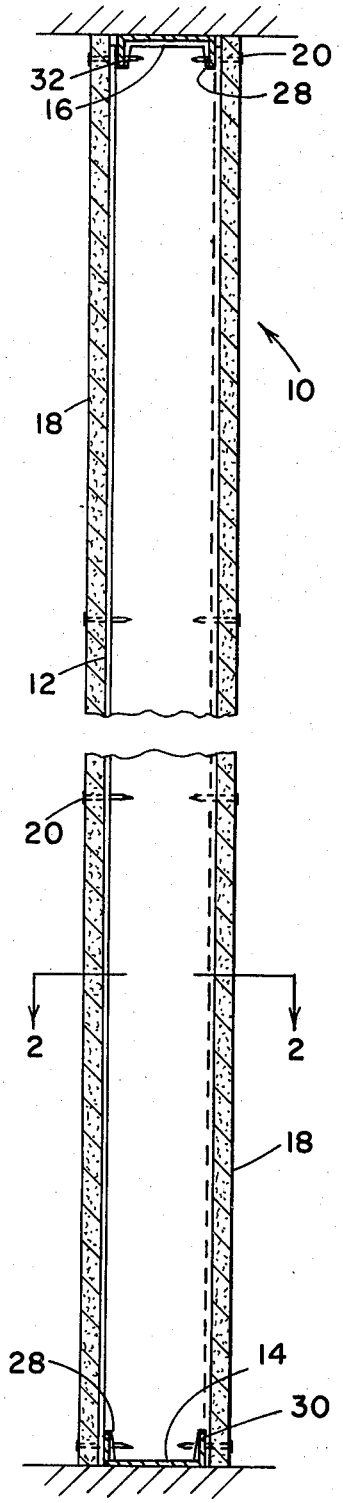
FIG. 1 is a vertical sectional view of a wall constructed in accordance with the present invention.
Figure 3:
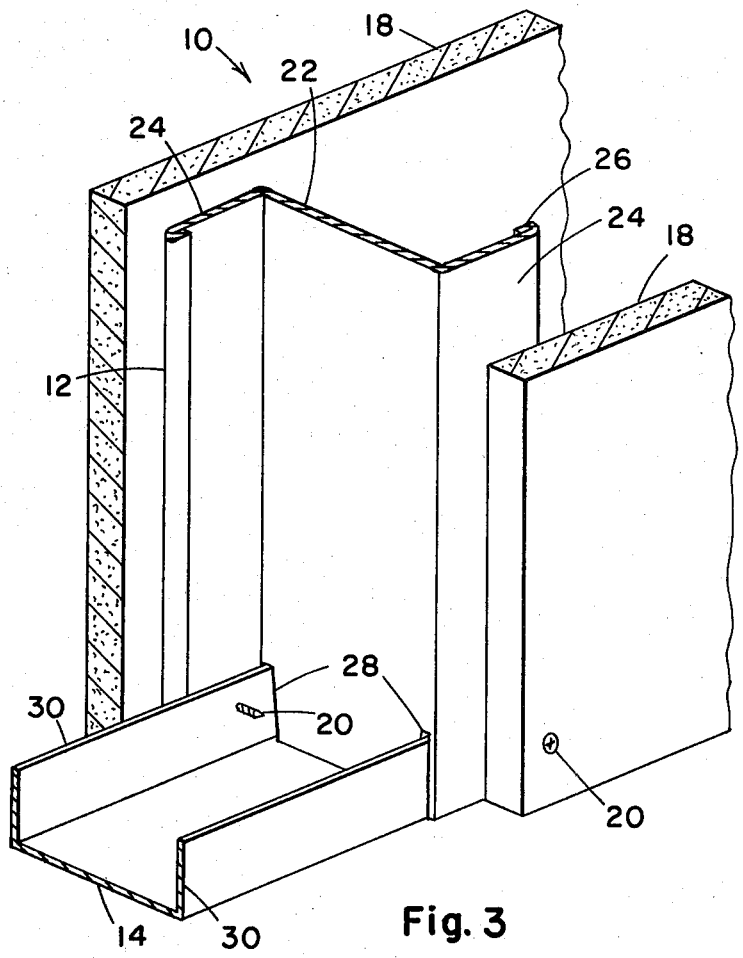
FIG. 3 is an isometric view of a section of the wall of FIG. 1 at the bottom thereof.
Figure 2:
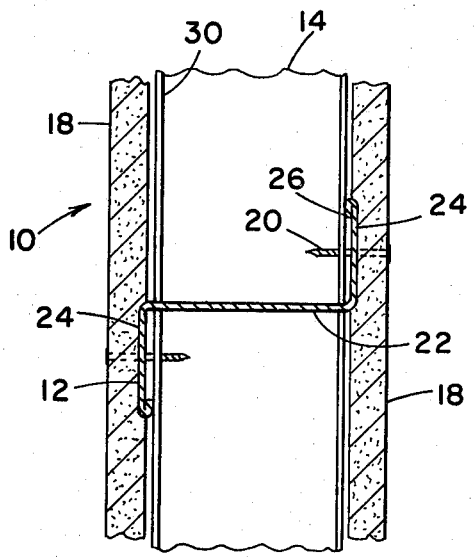
FIG. 2 is a horizontal sectional view of the wall of FIG. 1 taken on line 2—2 thereof.

Referring to FIGS. 1—3, there is shown a wall 10, consisting essentially of studs 12, floor runner 14, ceiling runner 16 and wallboard 18, with screws 20 affixing the wallboard 18 to the stud 12, floor runner 14 and ceiling runner 16.

The elongate, formed sheet metal stud 12 has an elongate central web 22 disposed perpendicular to the wallboard 18 which is on each side of the stud 12. The stud 12 also has two flanges 24, 24, one on each edge of web 22, with each flange extending perpendicular to the web. The two flanges 24, 24 extend in opposite directions from web 22, forming a cross-section of a double L-shape or a modified Z-shape, modified in that the two angles are each of about 90°. A narrow hem 26 of sheet metal is folded back on itself along each edge of the two flanges 24, 24.

The stud may be of any thickness from about 16 gauge down to about 26 gauge galvanized steel, but for typical screw application of gypsum wallboard it will be preferably of from 20 to 25 gauge.

At each end of stud 12, there is a short extent of each flange 24 which is not adjoined to web 22, formed preferably by a slot 28 which extends inward from the end of the stud 12 at the junction of the web 22 and each flange 24. The slot 28 extends about 30 mm inward from the end of the stud and is tapered in width from about 2 mm at the stud end to zero to 1 mm at the slot inner end.

The two slots 28, 28 at the bottom of stud 12 engage the two upwardly extending flanges 30, 30 of floor runner 14, which extend upward about 25 mm. The two slots 28, 28 at the top of stud 12 engage the two downwardly extending flanges 32, 32 of ceiling runner 16, which extend downward about 25 mm. The floor and ceiling runners will preferably be of the same gauge as the studs used therewith.

The wallboard 18 on each side of wall 10 is preferably gypsum wallboard. The wallboard is screw attached to the stud 12. Screws 20 extend through the wallboard and into the stud flanges 24, 24.

Screwing of the wallboard 18 to the flanges 24, 24 is made possible by the novel positioning of the ends of the flanges 24, 24 against the outer side of the flanges 30, 30 of the floor runner 14 and the outer side of the flanges 32, 32 of the ceiling runner.

The width of slots 28 can be considerably greater than 2 mm and the flange ends will still be supported for screw attachment of wallboard to the studs. The slots can have a width entirely across the web 22.

The preferred tapered 2 mm width can provide some transverse stability during erection, by the fact the slots will grasp the flanges 30 and 32 of the floor and ceiling runners.

The angle between the stud flanges 24, 24 and the stud web 22 may vary slightly from 90°, in accordance with the invention, however a variation of more than about 5° creates an increase in the web width, for a given wall thickness, which defeats the advantages provided of the most economical form of stud provided by the invention.

Erection of the wall of the invention begins with the attachment of floor runner 14 to floor 15 and ceiling runner 16 to ceiling 17 by any known means, with ceiling runner 16 parallel to and directly over floor runner 14. A stud 12 is then mounted vertically with the bottom and top ends of stud 12 mounted on respectively the floor runner 14 and the ceiling runner 16, with the ends of flanges 24 straddling the floor and ceiling runners.

In particular, the bottom ends of flanges 24 are placed against the outer sides of floor runner flanges 30, and the top ends of flanges 24 are placed against the outer sides of ceiling runner flanges 32.

Wallboard 18 is then placed against the outer face of a stud flange 24, and a suitable metal fastener, such as a screw 20, is mechanically forced through the wallboard 18 and the flange 24. The flange 24 remains firmly against the inner face of wallboard 18 as the fastener is forced therethrough, held there solely by the stud flange ends being disposed against the outer face of a flange 30 of floor runner 14 and the outer face of a flange 32 of ceiling runner 16.

Having completed a detailed disclosure of the preferred embodiments of my invention so that those skilled in the art may practice the same, I contemplate that variations may be made without departing from the essence of the invention.

I claim:

1. The method of erecting a wall comprising the steps of mounting a formed sheet metal stud vertically with respective ends mounted on a floor runner and a ceiling runner, said stud having an elongate flat central web and two elongate flat flanges, said two flanges extending from the two elongate edges of said web, said two flanges extending in opposite directions from said web and forming an angle of from about 85° to 95° with said web, said flanges having a short extent at each end which is separated from said web by a short slot extending inward from the end of the stud at each junction of the web and a flange at each end of the stud, with said flanges being free to straddle said floor and ceiling runners, disposing floor and ceiling runners each having a pair of vertical flanges extending toward said stud and with said flanges of each said runner extending toward the other runner disposing said stud flange bottom ends against respective outer sides of opposed vertical flanges on said floor runner and disposing said stud flange top ends against respective outer sides of opposed vertical flanges on said ceiling runner by disposing runner flanges within said slots, disposing wallboard against the outer face of one of said stud flanges, and forcing a metal fastening means through said wallboard and said stud flange while said stud flange remains held firmly against the wallboard inner face, said stud flange being held firmly against said wallboard inner face solely by the stud flange ends being disposed against the outer faces of runner flanges.

2. The method of claim 1 in which said slots are each tapered to progressively narrower width progressively inward of said slot from a width wider than the thickness of said runner flanges to a width narrower than said thickness of said runner flanges, further comprising the step of firmly engaging said slots at the stud bottom onto said floor runner flanges.

3. The method of claim 1 wherein said angle formed by said stud web and flanges is 90°.

* * * * *